US009273517B2

(12) United States Patent
Tchakarov et al.

(10) Patent No.: US 9,273,517 B2
(45) Date of Patent: Mar. 1, 2016

(54) DOWNHOLE CLOSED-LOOP GEOSTEERING METHODOLOGY

(75) Inventors: Borislav J. Tchakarov, Houston, TX (US); Tsili Wang, Katy, TX (US); Rodney S. Guenther, Houston, TX (US); Thanh H. Cao, Spring, TX (US); Caimu Tang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 479 days.

(21) Appl. No.: 12/859,416

(22) Filed: Aug. 19, 2010

(65) Prior Publication Data

US 2012/0046868 A1 Feb. 23, 2012

(51) Int. Cl.

| | |
|---|---|
| ***G01V 1/40*** | (2006.01) |
| ***E21B 7/04*** | (2006.01) |
| ***E21B 7/10*** | (2006.01) |
| ***E21B 47/022*** | (2012.01) |
| ***E21B 47/12*** | (2012.01) |

(52) U.S. Cl.

CPC ... *E21B 7/04* (2013.01); *E21B 7/10* (2013.01); *E21B 47/022* (2013.01); *E21B 47/124* (2013.01)

(58) Field of Classification Search

CPC ..... E21B 44/00; E21B 7/10
USPC ..... 702/9
See application file for complete search history.

(56) References Cited

U.S. PATENT DOCUMENTS

| | | | |
|---|---|---|---|
| 5,842,149 | A | 11/1998 | Harrell et al. |
| 6,088,294 | A | 7/2000 | Leggett |
| 6,092,610 | A | 7/2000 | Kosmala |
| 6,109,370 | A | 8/2000 | Gray |
| 6,181,138 | B1 | 1/2001 | Hagiwara et al. |
| 6,206,108 | B1 | 3/2001 | MacDonald et al. |
| 6,233,524 | B1 | 5/2001 | Harrell |
| 6,272,434 | B1 | 8/2001 | Wisler |
| 6,381,858 | B1 | 5/2002 | Shirasaka |
| 6,397,946 | B1 | 6/2002 | Vail |
| 6,464,021 | B1 | 10/2002 | Edwards |
| 6,476,609 | B1 | 11/2002 | Bittar |
| 6,513,606 | B1 | 2/2003 | Krueger |
| 6,601,658 | B1 | 8/2003 | Downton |
| 6,911,824 | B2 | 6/2005 | Bittar |

(Continued)

FOREIGN PATENT DOCUMENTS

| | | | |
|---|---|---|---|
| CN | 1228824 | A1 | 9/1999 |
| WO | WO 2009080711 | A2 * | 7/2009 |

OTHER PUBLICATIONS

International Search Report and Written Opinion of PCT Application Serial No. PCT/US2011/047204 dated Mar. 12, 2012.

(Continued)

*Primary Examiner* — Patrick Assouad
*Assistant Examiner* — Haidong Zhang
(74) *Attorney, Agent, or Firm* — Kimberly Ballew

(57) ABSTRACT

A closed-loop method for geosteering includes acquiring logging while drilling data and processing the logging while drilling data downhole while drilling to obtain a geosteering correction (a correction to the drilling direction based upon the LWD measurements). The geosteering correction is further processed downhole to obtain new steering tool settings which are then applied to the steering tool to change the direction of drilling. These steps are typically repeated numerous times without the need for uphole processing or surface intervention.

19 Claims, 5 Drawing Sheets

(56) References Cited

U.S. PATENT DOCUMENTS

| | | | | |
|---|---|---|---|---|
| 6,969,994 | B2 | 11/2005 | Minerbo | |
| 7,019,528 | B2 | 3/2006 | Bittar | |
| 7,027,926 | B2 | 4/2006 | Haugland | |
| 7,054,750 | B2 | 5/2006 | Rodney | |
| 7,057,392 | B2 | 6/2006 | Wang et al. | |
| 7,136,795 | B2 | 11/2006 | Downton | |
| 7,138,803 | B2 | 11/2006 | Bittar | |
| 7,202,670 | B2 | 4/2007 | Omeragic | |
| 7,265,552 | B2 | 9/2007 | Bittar | |
| 7,382,135 | B2 | 6/2008 | Li | |
| 7,414,407 | B2 | 8/2008 | Wang et al. | |
| 7,612,565 | B2 | 11/2009 | Seydoux | |
| 7,669,669 | B2 | 3/2010 | Downton et al. | |
| 7,703,548 | B2 | 4/2010 | Clark | |
| 7,751,280 | B2 | 7/2010 | Denichou et al. | |
| 7,957,946 | B2 | 6/2011 | Pirovolou | |
| 8,061,444 | B2 | 11/2011 | Mullins et al. | |
| 8,301,382 | B2 | 10/2012 | Herrera | |
| 2004/0016571 | A1 | 1/2004 | Krueger | |
| 2004/0050590 | A1* | 3/2004 | Pirovolou et al. | 175/61 |
| 2004/0154831 | A1* | 8/2004 | Seydoux et al. | 175/24 |
| 2007/0029112 | A1* | 2/2007 | Li et al. | 175/26 |
| 2007/0203651 | A1* | 8/2007 | Blanz et al. | 702/6 |
| 2009/0090555 | A1* | 4/2009 | Boone et al. | 175/45 |
| 2010/0123462 | A1 | 5/2010 | Bittar | |
| 2010/0175922 | A1 | 7/2010 | Ignova et al. | |
| 2010/0185395 | A1 | 7/2010 | Pirovolou et al. | |
| 2011/0213601 | A1 | 9/2011 | Pirovolou | |
| 2012/0046868 | A1 | 2/2012 | Tchakarov et al. | |
| 2013/0126239 | A1 | 5/2013 | Panchal et al. | |

OTHER PUBLICATIONS

First Office Action for Chinese Application No. 201180044533.4 dated Jan. 15, 2015.

Patent Examination Report No. 1 for Australian Patent Application No. 2011292262 dated May 29, 2014.

* cited by examiner

DOWNHOLE CLOSED-LOOP GEOSTEERING METHODOLOGY

RELATED APPLICATIONS

None.

FIELD OF THE INVENTION

The present invention relates generally to methods for drilling a subterranean borehole. More particularly, the invention relates to a downhole closed-loop method for geosteering.

BACKGROUND OF THE INVENTION

The use of on-site and remote geosteering methods are well known in the downhole drilling arts. During such geosteering operations, drilling typically proceeds according to a predetermined well plan (e.g., derived using geometric considerations in combination with a three dimensional model of the subterranean formations). Real-time geological measurements, for example, measurement while drilling (MWD), logging while drilling (LWD), and/or mud logging measurements, are made while drilling. Data obtained from these measurements are then used to make "on the fly" adjustments to the direction of drilling, for example, to maintain the drill bit at a desired location in a payzone.

In prior art geosteering operations, steering decisions are made at the surface, e.g., at the rig site or at a remote location. LWD data (or other downhole data) are compressed downhole and then transmitted to the surface while drilling (e.g., via conventional telemetry techniques). The transmitted data is then processed at the surface in combination with a model of the subterranean formations to determine a subsequent drilling direction (or a correction to the current drilling direction). Changes to the predetermined (preplanned) drilling direction (e.g., in the form of a corrected well path) are then transmitted from the surface to a downhole steering tool (e.g., via conventional downlinking techniques).

While such geosteering methods are commercially utilized, there remains room for improvement. For example, the viability of prior art geosteering methods is often limited by the bandwidth and accuracy of the communication channel between the bottom hole assembly (BHA) and the surface. This limitation can cause geosteering methods to be slow and somewhat unresponsive (e.g., due to the time lag associated with transmitting LWD measurements to the surface and then transmitting steering instructions or a corrected well plan from the surface to the BHA). Moreover, telemetry errors and/or the reduced accuracy that results from data compression can lead to further errors when computing the corrected well path. These and other limitations of prior art techniques lead to a need for improved geosteering methods.

SUMMARY OF THE INVENTION

Aspects of the present invention are intended to address the above described need for improved geosteering methods. Aspects of the present invention include a closed-loop method for geosteering. By closed-loop it is meant that the geosteering calculations and subsequent adjustments to the steering direction are made automatically downhole without the need for any uphole (surface) processing or decision making. Such autonomous downhole decision making is based on feedback obtained from various LWD measurements. These LWD measurements are processed downhole while drilling to obtain a geosteering correction (a correction to the drilling direction based upon the LWD measurements). The geosteering correction is further processed downhole to obtain new steering tool settings which are then applied to the steering tool to change the direction of drilling. These steps are typically repeated numerous times without the need for uphole processing or surface intervention.

Exemplary embodiments of the present invention may advantageously provide several technical advantages. For example, in providing a closed-loop methodology, the present invention tends to advantageously improve the timeliness and accuracy of geosteering operations. The invention tends to further improve borehole placement in the subterranean geology (e.g., in a predetermined payzone) while also reducing borehole tortuosity.

In one aspect the present invention includes a closed-loop method for geosteering a subterranean borehole. The method includes causing a bottom hole assembly to drill a subterranean borehole. The bottom hole assembly includes a drill bit, a steering tool, a logging while drilling tool, and a downhole processor. The method further includes causing the logging while drilling tool to acquire logging while drilling measurements while drilling and causing the downhole processor to compute a geosteering correction using the logging while drilling measurements. The method still further includes causing the downhole processor to compute new steering tool settings using the computed geosteering correction and applying the new steering tool settings to the steering tool while drilling.

In another aspect, the present invention includes a closed-loop method for geosteering a subterranean borehole. The method includes rotating a bottom hole assembly in a subterranean borehole, the bottom hole assembly including a drill bit, a steering tool, a directional resistivity logging while drilling tool, and a downhole processor. The directional resistivity logging while drilling tool acquires directional resistivity measurements while rotating and the downhole processor selects directional resistivity values from a downhole lookup table that most closely match the directional resistivity measurements. The downhole processor selects a geosteering well position from the downhole lookup table that corresponds with the directional resistivity logging while drilling values selected from the look up table. The downhole processor further computes a geosteering correction using the selected geosteering well position and new steering tool settings using the computed geosteering correction. The new steering tool settings are applied to the steering tool while drilling.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
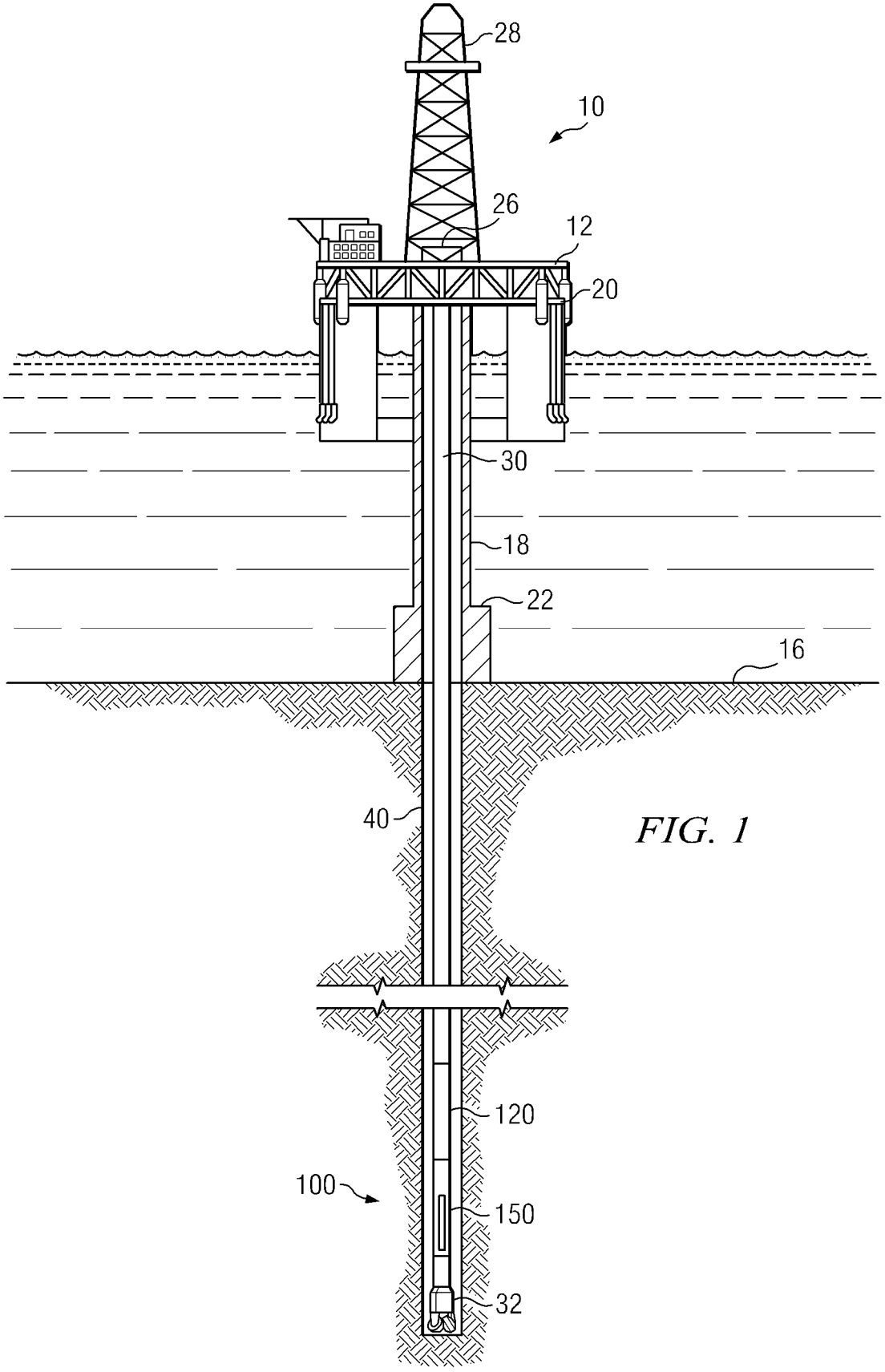
FIG. 1 depicts a conventional drilling rig on which exemplary method embodiments of the present invention may be utilized.

FIG. 1 depicts one exemplary embodiment of a bottom hole assembly (BHA) 100 in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes BHA 100. BHA 100 further includes a drill bit 32, a logging while drilling tool 120, and a steering tool 150. Drill string 30 may further optionally include other known downhole tools and sensors, for example, including a telemetry system, measurement while drilling sensors, fluid sampling tools, and the like. The invention is not limited by such optional tool deployments.

It will be understood by those of ordinary skill in the art that the deployment depicted on FIG. 1 is merely exemplary for purposes of describing the invention set forth herein. It will be further understood that method embodiments in accordance with the present invention are not limited to use with a semisubmersible platform 12 as illustrated on FIG. 1. The invention is equally well suited for use with any kind of subterranean drilling operation, either offshore or onshore.

Figure 2:
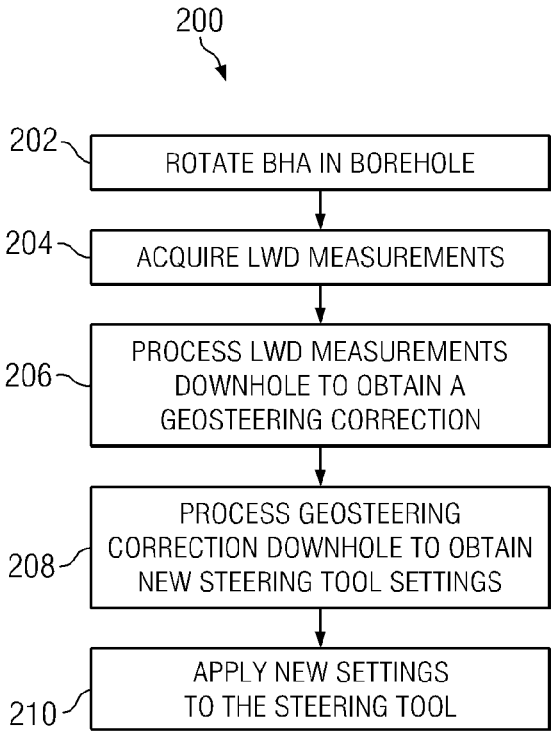
FIG. 2 depicts a flow chart of one exemplary closed-loop geosteering method embodiment in accordance with the present invention.

FIG. 2 depicts a flow chart of one exemplary method embodiment 200 in accordance with the present invention. As depicted, method 200 is a closed-loop method for geosteering. By closed-loop it is meant that the geosteering calculations and subsequent adjustments to the steering direction are made automatically downhole without the need for any uphole (surface) processing or decision making. Such autonomous downhole decision making is based on feedback obtained from various LWD measurements. A portion of the LWD data may optionally be transmitted uphole for surface monitoring of the closed loop geosteering process. At 202 of method 200 a subterranean borehole (or a section thereof) is drilled using convention directional drilling techniques (e.g., by rotating BHA 100 in the borehole). Logging while drilling measurements (preferably directional resistivity measurements) are acquired at 204. These LWD measurements are processed downhole while drilling to obtain a geosteering correction at 206. The geosteering correction is further processed downhole to obtain new steering tool settings at 208. These settings are then applied at 210 so as to change the direction of drilling. Method steps 204, 206, 208, and 210 may be repeated substantially any number of times while drilling without the need for uphole processing or surface intervention.

Figure 3:
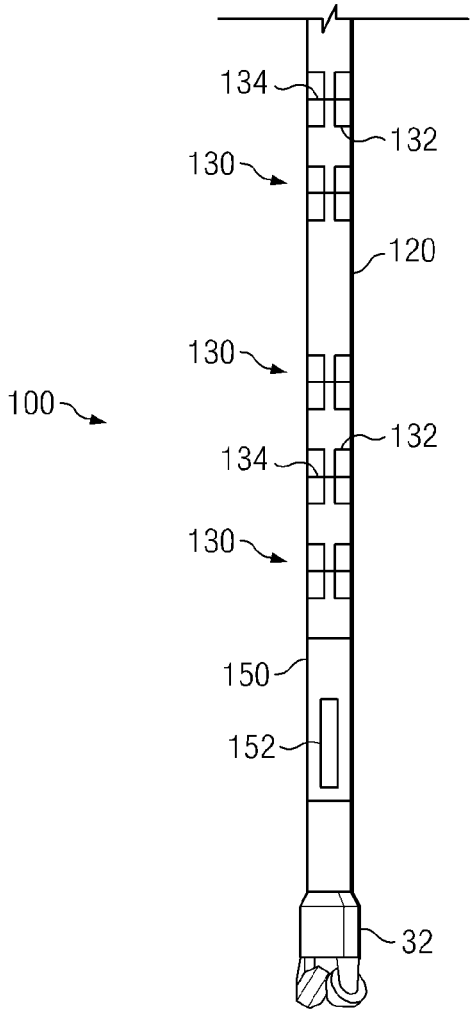
FIG. 3 depicts a portion of one exemplary embodiment of a bottom hole assembly suitable for use in exemplary method embodiments in accordance with the present invention.

FIG. 3 depicts a portion of BHA 100 (FIG. 1) in further detail. In the exemplary embodiment depicted, LWD tool 120 includes a directional resistivity LWD tool including one or more collocated antennae 130 deployed on the tool body. Each of the collocated antennae 130 includes a saddle coil 132 configured to transmit and/or receive x-mode (transverse mode) electromagnetic waves. The collocated antennae 130 further include a conventional axial coil 134 configured to transmit and/or receive z-mode (axial mode) electromagnetic waves. It will be understood that the invention is not limited to LWD tool embodiments including collocated antenna or saddle coils as depicted on FIG. 3. Substantially any suitable directional resistivity LWD tool configuration may be utilized. Other tool configurations are known to those of ordinary skill in the art. For example, U.S. Pat. No. 6,181,138 to Hagiwara teaches a method that employs an axial transmitting antenna and three co-located, circumferentially offset tilted receiving antennae. U.S. Pat. No. 6,969,994 to Minerbo et al., U.S. Pat. No. 7,202,670 to Omeragic et al., and U.S. Pat. No. 7,382,135 to Li et al teach a method that employs an axial transmitting antenna and two axially spaced tilted receiving antennae. The receiving antennae are further circumferentially offset from one another by an angle of 180 degrees. U.S. Pat. Nos. 6,476,609, 6,911,824, 7,019,528, 7,138,803, and 7,265,552 to Bittar teach a method that employs an axial transmitting antenna and two axially spaced tilted receiving antennae in which the tilted antennae are tilted in the same direction. U.S. Pat. Nos. 7,057,392 and 7,414,407 to Wang et al teach a method that employs an axial transmitting antenna and two longitudinally spaced transverse receiving antennae. It will be further understood that the invention is not even limited to embodiments that make use of directional resistivity measurements. Other LWD measurements (e.g., azimuthal gamma measurements) may also be utilized.

The exemplary embodiment of BHA 100 depicted on FIG. 3 further includes a rotary steerable steering tool 150. In the exemplary embodiment depicted, steering tool 150 includes a plurality of blades 152 configured to engage a borehole wall. To steer (e.g., to change the direction of drilling), one or more of the blades 152 are extended so as to exert a force against the borehole wall. The steering tool 150 is moved away from the center of the borehole by this operation, thereby altering the drilling path. It will be appreciated that the tool 100 may also be moved back towards the borehole axis if it is already eccentered.

It is well known that directional control of the borehole has become increasingly important in the drilling of subterranean oil and gas wells, with a significant proportion of current drilling activity involving the drilling of deviated boreholes. Such deviated boreholes often have complex profiles, including multiple doglegs and a horizontal section that may be guided through thin, fault bearing strata, and are typically utilized to more fully exploit hydrocarbon reservoirs (e.g., in geosteering operations). Deviated boreholes are often drilled using downhole steering tools, such as the rotary steerable tool 150 depicted on FIG. 3. In such tool embodiments, the direction of drilling may be controlled, for example, by controlling the magnitude and direction of the force or the magnitude and direction of the displacement applied to the borehole wall. In some rotary steerable tools, the blade housing is deployed about a rotatable shaft. The shaft is coupled to the drill string and disposed to transfer weight and torque from the surface (or from a mud motor) through the steering tool to the drill bit assembly. Other rotary steerable tools are known that utilize an internal steering mechanism and therefore don't require blades (e.g., the Schlumberger PowerDrive rotary steerable tools). The invention is not limited to any particular steering tool embodiment.

Figure 4:
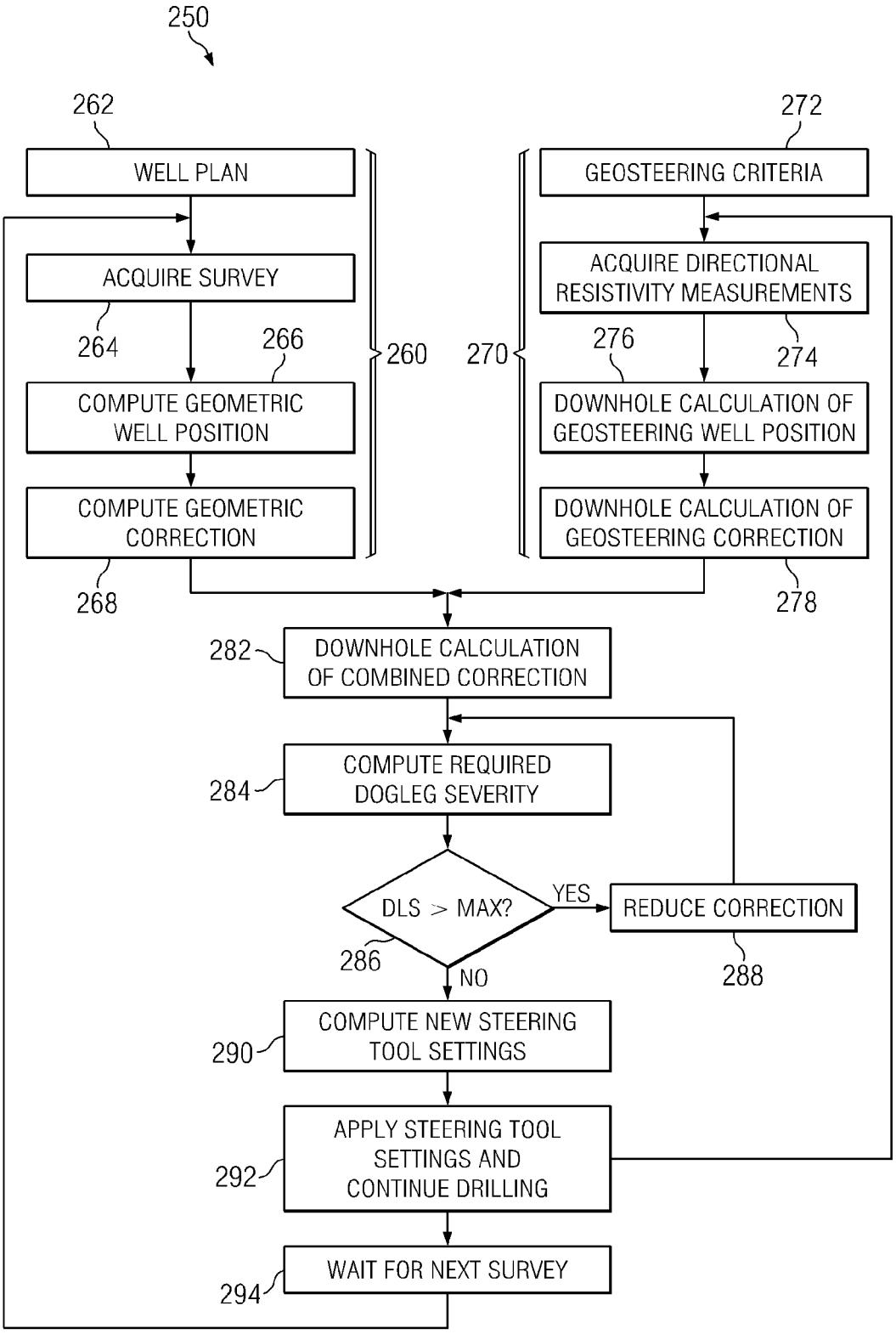
FIG. 4 depicts a flow chart of another exemplary closed-loop geosteering method embodiment in accordance with the present invention.

FIG. 4 depicts a flow chart of another exemplary method embodiment 250 in accordance with the present invention. In the exemplary embodiment depicted first and second geometric 260 and geosteering 270 algorithms are utilized in parallel to achieve an optimum well placement. The geometric algorithm 260 is based upon a predetermined geometric well plan 262 derived, for example, from a field development plan. As is known to those of ordinary skill in the art, a typical field development plan is commonly designed to achieve maximum drainage and is often based upon structural knowledge of the field obtained from seismic profiles, offset wells, and previous wells drilled in the area. Conventional surveys are acquired at 264. These surveys typically include borehole azimuth and borehole inclination measurements and are commonly obtained at about 30 foot intervals in measured depth (e.g., when a new section of drill pipe is added to the drill string). A geometric well position is computed at 266 using the survey measurements acquired in 264 (e.g., using minimum curvature assumptions). Techniques for making such calculations are well known in the art. At 268 a geometric correction is computed, for example, by comparing the geometric well position computed in 266 with the well plan.

The geosteering algorithm 270 is based upon predetermined geosteering criteria 272. These criteria are typically based on various formation properties and a desired placement distance and/or direction between a borehole and an identified boundary. For example, in certain operations it may be desirable to maintain the borehole within a payzone or at some predetermined distance above or below a particular boundary layer (e.g., 5 feet below an upper boundary layer). In preferred embodiments of the invention, geosteering calculations are based upon directional resistivity measurements acquired, for example, at 274. The directional resistivity measurements may then be used to compute a geosteering well position at 276 (e.g., a relative well position with respect to a particular boundary layer). As described in more detail below, these calculations are performed downhole while drilling. At 278 a geosteering correction is computed, for example, by comparing the geosteering well position computed in 276 with the geosteering criteria.

With continued reference to FIG. 4, a combined correction is computed downhole at 282, for example, by comparing, averaging, or otherwise co-processing the geometric correction computed in 268 and the geosteering correction computed in 278. The combined correction may be compared with the original well plan to determine a required dogleg severity (DLS) at 284. If the required DLS is greater than or equal to a predetermined maximum DLS at 286, then the combined correction is reduced at 288 and the DLS recomputed. When the DLS is less than the predetermined maximum at 286, new steering tool settings are computed at 290 and then applied to the steering tool at 292 to control the direction of drilling. The method then loops back and acquires additional directional resistivity data at 274 and repeats the geosteering algorithm 270 substantially continuously while drilling. It will be understood that the acquisition of subsequent directional resistivity data at 274 may occur prior to the completion of step 292. The method 250 also waits at 294 for the acquisition of additional survey data at 264 (e.g., until the next section of drill pipe is added to the drill string).

Figure 5:
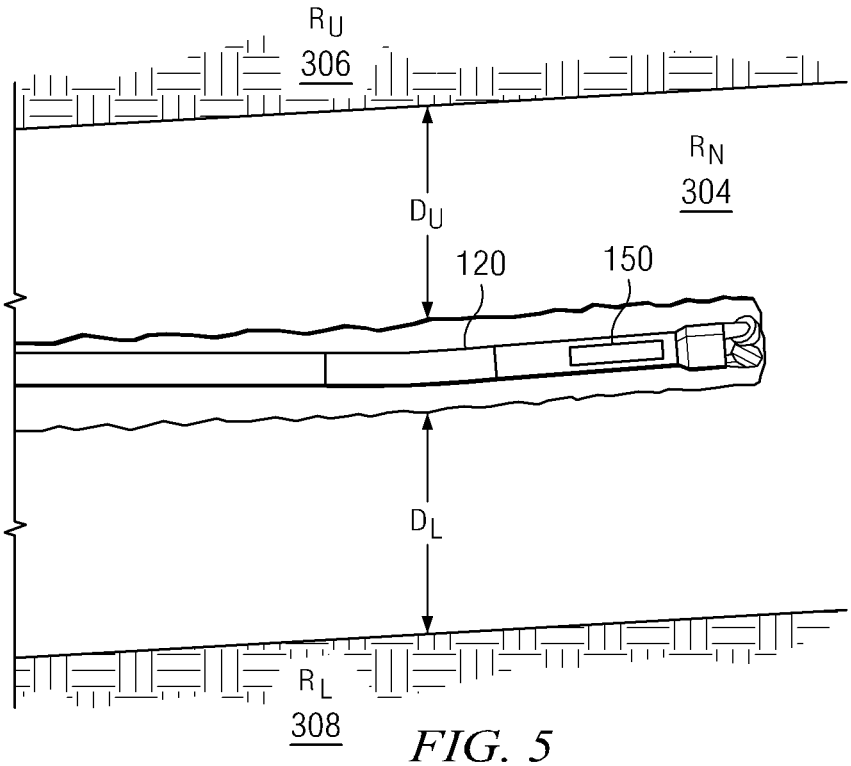
FIG. 5 depicts an exemplary three-layer formation model suitable for use in the method embodiments depicted on FIGS. 2 and 4.

FIG. 5 depicts one exemplary embodiment of a three-layer formation model that may be utilized in the geosteering calculations depicted at 206 in FIGS. 2 and 276 of FIG. 4. In FIG. 5 a logging while drilling tool 120 (e.g., a directional resistivity tool or an azimuthal gamma tool) is depicted as being deployed in a near bed 304 substantially vertically between upper 306 and lower 308 beds. In the exemplary embodiment depicted, the three-layer model may be characterized by five measured parameters. These parameters may include, for example, a resistivity of the near bed 304 ($R_N$), a resistivity of the upper bed 306 ($R_U$), and a resistivity of the lower bed 308 ($R_L$). The parameters may further include a distance between the directional resistivity tool 302 and the upper bed 306 ($D_U$) and a distance between the directional resistivity tool 302 and the lower bed 308 ($D_L$).

While the invention is not limited in this regard, the exemplary closed-loop geosteering method depicted on FIG. 4 makes use of downhole feedback obtained from directional resistivity measurements acquired at 274. Those of skill in the art will readily appreciate that various components of a directional resistivity measurement are highly sensitive to and may be used to compute one or more of the parameters depicted on FIG. 5. These components may include, for example, a measured axial component (e.g., the $H_{zz}$ component), a measured cross-component (e.g., the $H_{zx}$ component), and/or a measured transverse component (e.g., the $H_{xx}$ component).

Azimuth (toolface) measurements are preferably also acquired at 274. The directional resistivity measurements are then preferably correlated with the azimuth measurements such that each directional resistivity measurement is assigned a corresponding azimuth angle (toolface angle). The azimuth measurements may be utilized, for example, to distribute the directional resistivity data into multiple azimuthal sectors (e.g., 16 or 32 sectors). Techniques for "sectorizing" LWD data are known in the art. Those of ordinary skill in the art will readily understand that the terms "azimuth" and "toolface" as used herein refer to an angular measurement about the circumference of the tool 100. In particular, these terms refer to the angular separation from a point of interest (e.g., an LWD sensor) to a reference point (e.g., the high side of the borehole).

Figure 6:
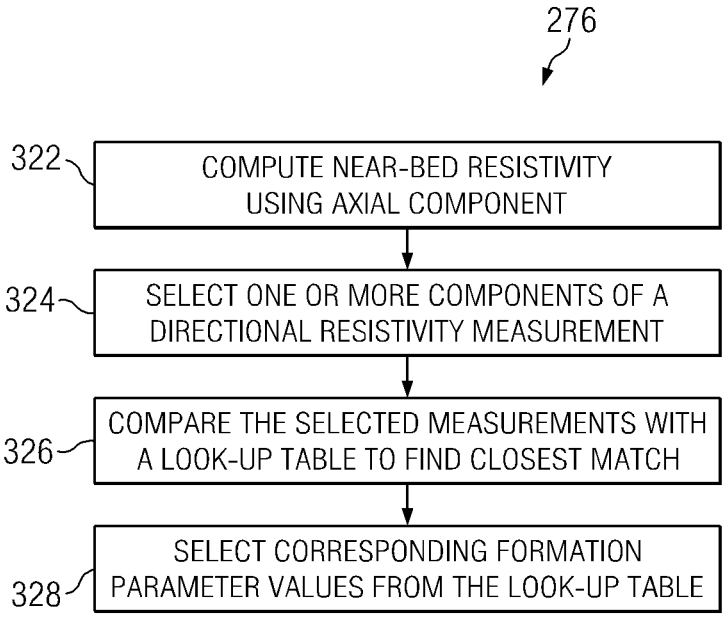
FIG. 6 depicts a flow chart of a preferred method for computing a geosteering well position downhole while drilling.

FIG. 6 depicts a flow chart of one exemplary method embodiment by which the geosteering well position may be computed downhole in 276 (FIG. 4). In the exemplary embodiment depicted, a measured axial component may be utilized to calculate the resistivity $R_N$ of the near bed at 322. At 324 one or more components of at least one directional resistivity measurement may be selected for use in determining $R_U$, $R_L$, $D_U$, and $D_L$, (FIG. 5). For example, measurements of one or more cross components and/or transverse components may be selected in 324 (although cross components are generally preferred). Both near field and/or far field measurements may also be selected. The directional resistivity measurements selected in 324 may then be compared with values stored in a look-up table to find the closest match (e.g., via incrementally searching the LUT). Corresponding parameter values are selected for $R_U$, $D_U$, and $D_L$ from a corresponding LUT at 328 based on the closest directional resistivity values acquired at 326. The parameter values obtained in 322 and/or 328 may then be utilized to compute a geosteering correction at 278 (FIG. 4). For example, in one exemplary embodiment, the value of $D_U$ may be compared with a predetermined value. If $D_U$ is less than the predetermined value, the borehole inclination may be dropped so as to increase the distance to the upper boundary. If $D_U$ is greater than the predetermined value, the borehole inclination may be built up so as to decrease the distance to the upper boundary.

It will be understood to those of skill in the art that additional parameters may be selected at 328. For example, the LUT may further include directional information regarding the location of the upper and/or lower beds. Such directional information may include, for example, an azimuth (toolface) angle relative to the high side of the BHA. The LUT may still further include a dip angle of the upper and/or lower bed relative to the trajectory of the well. These parameters may also be utilized to compute the geosteering correction at 278.

As discussed above, aspects of the present invention include a closed-loop method for geosteering. By closed-loop it is meant that the geosteering calculations and subsequent adjustments to the steering direction are made automatically downhole without the need for any uphole (surface) processing or decision making. Such autonomous downhole decision making is based on feedback obtained from various LWD measurements, preferably directional resistivity measurements as described above with respect to FIGS. 4 and 6. To achieve a fully closed-loop system in practice requires rapid downhole data processing and decision making. Such a system may include novel hardware and processing algorithms as well as efficient software implementation.

Figure 7:
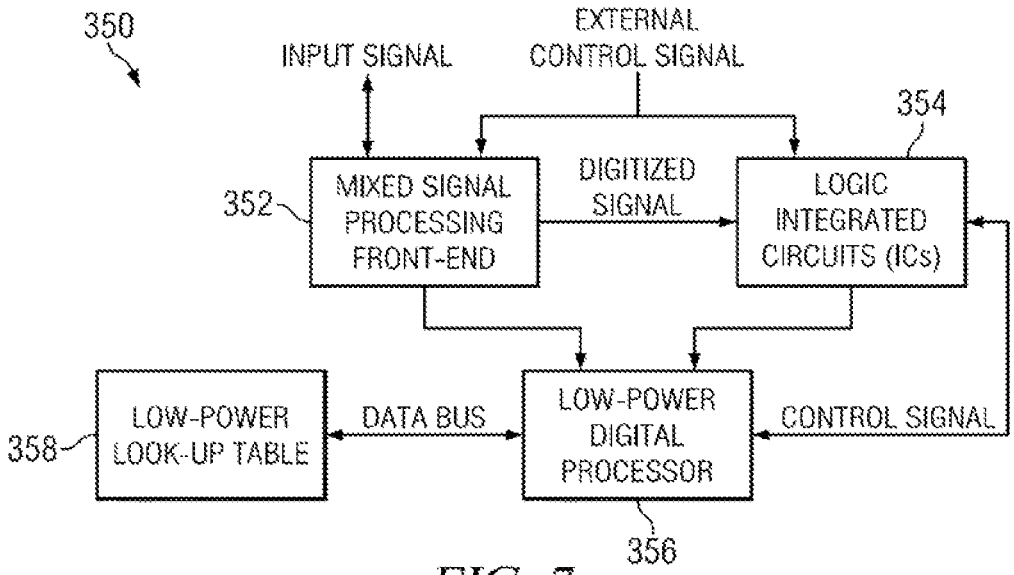
FIG. 7 depicts a downhole computation module suitable for use in exemplary embodiment of the present invention.

FIG. 7 depicts a top-level view of one exemplary embodiment of a preferred computation module 350 used to make the downhole geosteering calculations in 276 and 278 of method 250 (FIG. 4). The exemplary computation module 350 depicted includes four primary components, a mixed signal processing front-end 352, a logic integrated circuit 354 (e.g., including a field programmable gate array (FPGA) or application specific integrated circuit (ASIC)), a low-power digital processor 356 (e.g., a low-power DSP), and a low-power lookup table (LUT) memory (e.g., deployed downhole on an external flash chip). These four components may be viewed as hardware resources from the perspective of real-time sensing and processing. It will be understood that components 354, 356, and 358 are not necessarily discrete components as they may be integrated into one or more modules. It will be further understood computation module 350 is typically (although not necessarily) deployed on multiple digital circuit boards. The invention is not limited in these regards.

Figure 8:
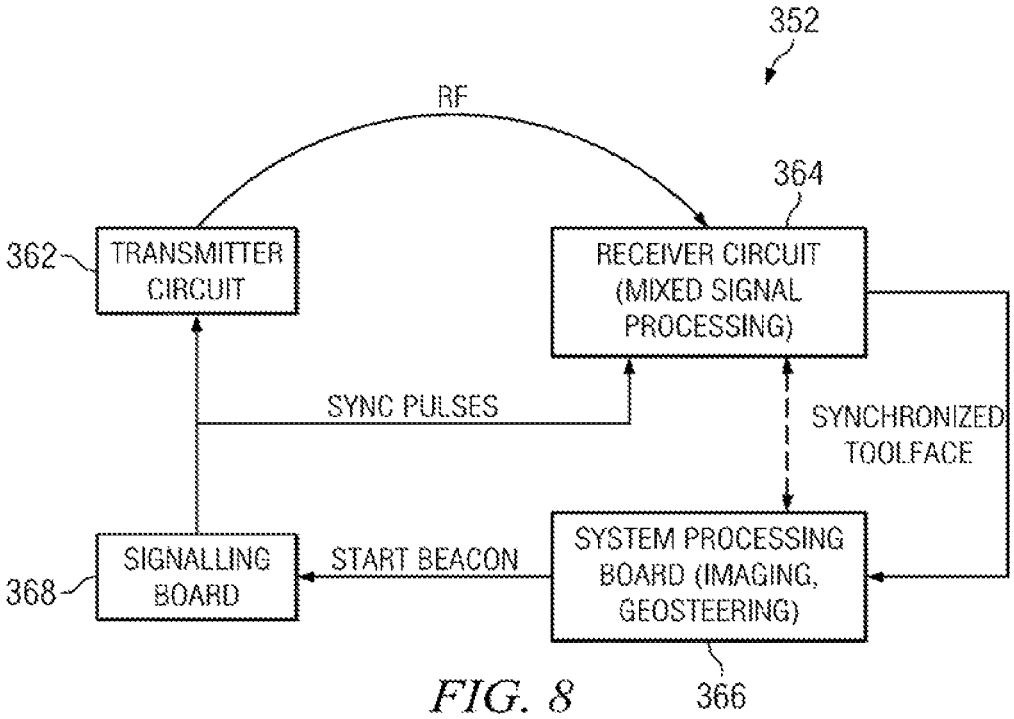
FIG. 8 depicts one exemplary embodiment of the mixed signal processing front-end depicted on FIG. 7

FIG. 8 depicts a preferred embodiment of the mixed signal processing front-end 352 depicted on FIG. 7. Front-end 352 includes at least one transmitting circuit 362 (e.g., for an x-mode or a z-mode transmitter) and at least one receiving circuit 364 (e.g., for an x-mode or z-mode receiver). It will be understood that multiple transmitting 362 and receiving 364 circuit boards may be utilized to provide for the use of multiple RF frequencies and/or firing intervals. The invention is not limited in these regards. Receiving circuit 364 is coupled with a system processing board 366. Synchronized azimuth (toolface) measurements may also be input into receiving circuit 364 or system processing board 366 to provide for directional resistivity image formation. Front-end 352 may further include a signaling circuit 368 in communication with the processing board 366 via a start beacon.

Computation module 350 is deployed downhole (e.g., in electronic communication with an LWD and/or steering tool controller) and is configured for making the geosteering calculations and corrections in substantially real-time while drilling. Directional resistivity geosteering calculations are commonly modeled as a non-linear system fitting problem (both in the prior art and in the present invention). It is well-known in the art that this type of mathematical problem is of a size and complexity that requires substantial computational resources (well beyond any state-of-the-art low-power DSP or integrated circuit suitable for deployment downhole). Computation module 350 is configured for making such calculations in substantially real-time while drilling, for example, by matching a set of parameters calculated in real-time downhole with an entry in a large off-line table. In the exemplary embodiment depicted on FIG. 7, the use of a logic integrated circuit 354 and the use of a low-power LUT memory chip 358 provide for significant enhancements to the rate of downhole processing. The use of a low-power LUT also provides for significant downhole power savings.

In one exemplary embodiment LUT 358 comprises a non volatile low-power flash memory (e.g., a 1 gigabit chip). Those of skill in the art will appreciate that the LUT memory does not necessarily require a dedicated chip. The LUT is configured to facilitate inverse modeling of the subterranean formation and the logging while drilling measurements. In one exemplary embodiment a large array of formation parameters may be stored in the LUT. These parameters may include, for example, upper and lower bed resistivities $R_U$ and $R_L$, and distances to the upper lower bed $D_U$ and $D_L$ as depicted on FIG. 5. The parameters may still further include, for example, a toolface angle (a direction) to the upper boundary and a dipping angle of the upper boundary. In one preferred exemplary embodiment, the LUT includes a 4 parameter ($R_U$, $R_L$, $D_U$, and $D_L$) 16 level array (for a total of $16^4$—65,536 entries). Each entry further includes directional resistivity values corresponding to the four parameter values. These directional resistivity values may include, for example, attenuation and phase for a plurality of directional resistivity component measurements. The directional resistivity values are computed at the surface using an inverse model and loaded into the lookup table.

It will be understood that the aspects and features of the present invention may be embodied as logic that may be processed by, for example, a computer, a microprocessor, hardware, firmware, programmable circuitry, or any other processing device known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

We claim:

1. A closed-loop method for geosteering a subterranean borehole, the method comprising:

(a) rotating a bottom hole assembly in a subterranean borehole, the bottom hole assembly including a drill bit, a steering tool, a directional resistivity logging while drilling tool, a downhole processor, and signal processing front-end circuitry in electronic communication with the downhole processor, wherein the signal processing front-end circuitry includes at least one transmitter circuit, at least one receiver circuit, and at least one additional processing circuit in communication with the at least one receiver circuit;

(b) causing the directional resistivity logging while drilling tool to acquire directional resistivity measurements while rotating in (a), wherein the directional resistivity measurements are acquired as a result of a signal being transmitted using the at least one transmitter circuit and the transmitted signal being received by the at least one receiver circuit, and wherein (b) further comprises providing synchronized azimuth measurements to at least one of the at least one receiver circuit or the at least one additional processing circuit to provide directional resistivity image formation;

(c) causing the downhole processor to compute a geosteering correction using the directional resistivity measurements acquired in (b);

(d) causing the downhole processor to compute new steering tool settings using the geosteering correction computed in (c); and (e) applying the new steering tool settings computed in (d) to the steering tool while rotating the bottom hole assembly in (a).

2. The method of claim 1, further comprising:

(f) repeating (b), (c), (d), and (e) a plurality of times while rotating the bottom hole assembly in (a).

3. The method of claim 1, wherein (c) further comprises:

(i) causing the downhole processor to compute a geosteering well position using the directional resistivity measurements acquired in (b);

(ii) causing the downhole processor to compute the geosteering correction using the geosteering well position computed in (i).

4. The method of claim 3, wherein the geosteering well position comprises at least a distance between the directional resistivity tool and a predetermined formation boundary layer.

5. The method of claim 1, wherein (c) further comprises:

(i) causing the downhole processor to select directional resistivity values from a downhole lookup table that most closely match the directional resistivity measurements acquired in (b);

(ii) causing the downhole processor to select a geosteering well position from the downhole lookup table that corresponds with the directional resistivity logging while drilling values selected in (i);

(iii) causing the downhole processor to compute the geosteering correction using the geosteering well position selected in (ii).

6. The method of claim 5, wherein the geosteering well position comprises a distance between the directional resistivity tool and a predetermined formation boundary layer.

7. The method of claim 1, wherein the additional processing circuit provides a start beacon signal to a signaling board in communication with the transmitter circuit.

8. A closed-loop method for geosteering a subterranean borehole, the method comprising:

(a) rotating a bottom hole assembly in a subterranean borehole, the bottom hole assembly including a drill bit, a steering tool, a directional resistivity logging while drilling tool, and a downhole processor;

(b) causing the directional resistivity logging while drilling tool to acquire directional resistivity measurements while rotating in (a);

(c) causing the downhole processor to select directional resistivity values from a downhole lookup table, the directional resistivity values selected so that they most closely match the directional resistivity measurements acquired in (b);

(d) causing the downhole processor to select a geosteering well position from the downhole lookup table that corresponds with the directional resistivity logging while drilling values selected in (c);

(e) causing the downhole processor to compute a geosteering correction using the geosteering well position selected in (d);

(f) causing the downhole processor to compute new steering tool settings using the geosteering correction computed in (e); and (g) applying the new steering tool settings computed in (f) to the steering tool while rotating the bottom hole assembly in (a).

9. The method of claim 8, further comprising:

(f) repeating (b), (c), (d), and (e) a plurality of times while rotating the bottom hole assembly in (a).

10. The method of claim 8, wherein the geosteering well position comprises at least a distance between the directional resistivity tool and a predetermined formation boundary layer.

11. The method of claim 8, wherein the geosteering well position comprises a first distance between the directional resistivity tool and a first predetermined formation boundary layer and a second distance between the directional resistivity tool and a second predetermined formation boundary layer.

12. The method of claim 11, wherein the geosteering well position further comprises a resistivity of a near bed, a resistivity of an upper bed, and a resistivity of a lower bed.

13. The method of claim 8, wherein the bottom hole assembly of (a) further includes signal processing front-end circuitry in electronic communication with the downhole processor, wherein the signal processing front-end circuitry includes at least one transmitter circuit, at least one receiver circuit, and at least one additional processing circuit in communication with the at least one receiver circuit, and wherein the directional resistivity measurements in (b) are acquired as a result of a signal being transmitted using the at least one transmitter circuit and the transmitted signal being received by the at least one receiver circuit, and wherein (b) further comprises providing synchronized azimuth measurements to at least one of the at least one receiver circuit or the at least one additional processing circuit to provide directional resistivity image formation.

14. The method of claim 13, wherein the additional processing circuit provides a start beacon signal to a signaling board in communication with the transmitter circuit.

15. A closed-loop method for geosteering a subterranean borehole, the method comprising:

(a) rotating a bottom hole assembly in a subterranean borehole, the bottom hole assembly including a drill bit, a steering tool, a directional resistivity logging while drilling tool, and a downhole processor;

(b) causing the downhole processor to compute a geometric well position from a borehole survey;

(c) causing the downhole processor to compute a geometric correction from the geometric well position computed in (b);

(d) causing the directional resistivity logging while drilling tool to acquire directional resistivity measurements while rotating in (a);

(e) causing the downhole processor to compute a geosteering correction using the directional resistivity measurements acquired in (d) by causing the downhole processor to select directional resistivity values from a downhole lookup table that most closely match the directional resistivity measurements acquired in (d), causing the downhole processor to select a geosteering well position from the downhole lookup table that corresponds with the selected directional resistivity values, and causing the downhole processor to compute the geosteering correction using the selected geosteering well position;

(f) causing the downhole processor to compute a combined correction using the geometric correction computed in (c) and the geosteering correction computed in (e);

(g) causing the downhole processor to compute new steering tool settings using the combined correction computed in (f); and (h) applying the new steering tool settings computed in (g) to the steering tool while rotating the bottom hole assembly in (a).

16. The method of claim 15, further comprising:

(f) repeating (d), (e), (f), (g), and (h) a plurality of times while rotating the bottom hole assembly in (a).

17. The method of claim 15, wherein (f) comprises:

(i) causing the downhole processor to compute a required dogleg severity from the combined correction;

(ii) comparing the dogleg severity computed in (i) with a predetermined maximum dogleg severity;

(iii) reducing the combined correction when the dogleg severity computed in (i) is greater than the maximum dogleg severity.

18. The method of claim 15, wherein the bottom hole assembly of (a) further includes signal processing front-end circuitry in electronic communication with the downhole processor, wherein the signal processing front-end circuitry includes at least one transmitter circuit, at least one receiver circuit, and at least one additional processing circuit in communication with the at least one receiver circuit, and wherein the directional resistivity measurements in (d) are acquired as a result of a signal being transmitted using the at least one transmitter circuit and the transmitted signal being received by the at least one receiver circuit, and wherein (d) further comprises providing synchronized azimuth measurements to at least one of the at least one receiver circuit or the at least one additional processing circuit to provide directional resistivity image formation.

19. The method of claim 18, wherein the additional processing circuit provides a start beacon signal to a signaling board in communication with the transmitter circuit.

* * * * *